US010913303B2

(12) United States Patent
Fu et al.

(10) Patent No.: US 10,913,303 B2
(45) Date of Patent: Feb. 9, 2021

(54) PRINTABLE RECORDING MEDIUM

(71) Applicant: Hewlett-Packard Development Company, L.P., Houston, TX (US)

(72) Inventors: Xulong Fu, San Diego, CA (US); Fereshteh Khorrami, San Diego, CA (US); Tao Chen, San Diego, CA (US); Beverly Chou, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 86 days.

(21) Appl. No.: 16/311,048

(22) PCT Filed: Oct. 26, 2016

(86) PCT No.: PCT/US2016/058901
§ 371 (c)(1),
(2) Date: Dec. 18, 2018

(87) PCT Pub. No.: WO2018/080485
PCT Pub. Date: May 3, 2018

(65) Prior Publication Data

US 2019/0329581 A1 Oct. 31, 2019

(51) Int. Cl.
*B41M 5/00* (2006.01)
*B41M 5/50* (2006.01)
*B41M 5/52* (2006.01)

(52) U.S. Cl.
CPC ..... *B41M 5/502* (2013.01); *B41M 5/504* (2013.01); *B41M 5/508* (2013.01); *B41M 5/5218* (2013.01); *B41M 5/5245* (2013.01)

(58) Field of Classification Search
CPC ..... B41M 5/504; B41M 5/506; B41M 5/508; B41M 5/5245; B41M 7/0036; B41J 2/01
USPC ..... 428/32.21
See application file for complete search history.

(56) References Cited

U.S. PATENT DOCUMENTS

| | | | |
|---|---|---|---|
| 6,573,011 | B1 | 6/2003 | Nair et al. |
| 6,919,110 | B2 | 7/2005 | Oketani et al. |
| 7,824,030 | B2 | 11/2010 | Laney et al. |
| 8,425,031 | B2 | 4/2013 | Ohshima et al. |

(Continued)

FOREIGN PATENT DOCUMENTS

| | | |
|---|---|---|
| EP | 1566281 | 8/2005 |
| JP | 2007145372 | 6/2007 |

(Continued)

OTHER PUBLICATIONS

International Search Report and Written Opinion for International Application No. PCT/US2016/058901 dated Jul. 20, 2017, 8 pages.

*Primary Examiner* — Betelhem Shewareged
(74) *Attorney, Agent, or Firm* — Dierker & Kavanaugh PC

(57) ABSTRACT

An example of a printable recording medium includes a base substrate, a first ink-receiving layer, and a second ink-receiving layer. The first ink-receiving layer includes a first inorganic pigment in an amount equal to or greater than 70 wt % and a first ink-fixing agent in an amount ranging from about 3 wt % to about 10 wt % based on a total wt % of the first ink-receiving layer. The second ink-receiving layer includes a second inorganic pigment. Both the first ink-receiving layer and the second ink-receiving layer exclude precipitated calcium carbonate.

14 Claims, 2 Drawing Sheets

(56) References Cited

U.S. PATENT DOCUMENTS

| | | | | |
|---|---|---|---|---|
| 9,004,663 | B2 | 4/2015 | Van Thillo et al. | |
| 9,017,779 | B2 | 4/2015 | Ikeda et al. | |
| 9,138,000 | B2 | 9/2015 | Chason et al. | |
| 9,376,582 | B1 | 6/2016 | Dannhauser et al. | |
| 2003/0070582 | A1 | 4/2003 | Kitamura et al. | |
| 2003/0228428 | A1 | 12/2003 | Kim | |
| 2005/0153147 | A1 | 7/2005 | Khoultchaev | |
| 2006/0088672 | A1 | 4/2006 | Totani et al. | |
| 2009/0035489 | A1* | 2/2009 | Kaimoto | B41M 5/502 428/32.1 |
| 2009/0136692 | A1* | 5/2009 | Takahashi | B41M 5/506 428/32.25 |
| 2011/0303113 | A1* | 12/2011 | Sarkisian | B41F 23/00 101/491 |
| 2013/0257990 | A1 | 10/2013 | Swei | |
| 2013/0293647 | A1 | 11/2013 | Dannhauser et al. | |
| 2014/0116276 | A1 | 5/2014 | Bird et al. | |
| 2014/0139601 | A1 | 5/2014 | Pal et al. | |
| 2015/0298479 | A1 | 10/2015 | Watanabe et al. | |
| 2016/0237626 | A1 | 8/2016 | Anderson et al. | |

FOREIGN PATENT DOCUMENTS

| | | |
|---|---|---|
| JP | 2013216878 | 10/2013 |
| WO | WO 2013015767 | 1/2013 |

* cited by examiner

PRINTABLE RECORDING MEDIUM

BACKGROUND

In addition to home and office usage, inkjet technology has been expanded to high-speed, commercial and industrial printing. Inkjet printing is a non-impact printing method that utilizes electronic signals to control and direct droplets or a stream of ink to be deposited on media. Some commercial and industrial inkjet printers utilize fixed printheads and a moving substrate web in order to achieve high speed printing. Current inkjet printing technology involves forcing the ink drops through small nozzles by thermal ejection, piezoelectric pressure or oscillation onto the surface of the media. This technology has become a popular way of recording images on various media surfaces (e.g., paper), for a number of reasons, including, low printer noise, capability of high-speed recording and multi-color recording.

BRIEF DESCRIPTION OF THE DRAWINGS

Features of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
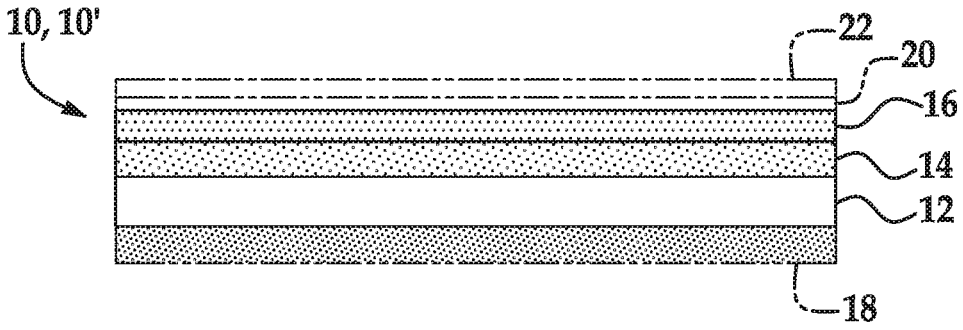
FIG. 1 is cross-sectional view of an example of a printable recording medium disclosed herein.

Inkjet web printing is a technology that is well adapted for commercial and package printing. Though there has been great improvement in high-speed inkjet printing, it is desirable to provide higher resolution, increased durability and ability to print on package material such as corrugated liner paper, for example on glossy package liner.

The corrugation process subjects the components, including the print, to elevated temperatures, on the order of about 350° F. (about 177° C.). Such temperatures can degrade the printed image and result in a reduction of image quality, particularly if the ink is an inkjet ink. The printed surface of the uncoated or coated media is exposed to a heated plate during the corrugation process, and as a result, the surface and the image at the surface may become scratched.

Ink-receiving layers of printable recording media may contain inorganic pigments. One inorganic pigment that is commonly used in printable recording media is precipitated calcium carbonate. However, it has been unexpectedly discovered that precipitated calcium carbonate (PCC) may, in some instances, be incompatible with ink-fixing agents.

Some examples of ink-fixing agents that may be incompatible with precipitated calcium carbonate include calcium chloride, magnesium chloride, calcium bromide, magnesium bromide, calcium nitrate, magnesium nitrate, and aluminum chlorohydrate. Ink-fixing agents may improve the image quality performance and/or the durability performance of an image printed on the printable recording medium.

However, when precipitated calcium carbonate is included in an ink-receiving layer fluid and comes into contact with an ink-fixing agent in an adjacent ink-receiving layer, it is believed that the ink-fixing agent destabilizes the precipitated calcium carbonate at the interface of the two layers, and causes agglomeration. This may deleteriously affect the coater runnability of the ink-receiving layer fluid at high speeds (e.g., using a pilot blade coater with a roll applicator at about 600 meters per minute (mpm)) due to a dry coating buildup (from the agglomeration) at the blade, and the coating getting undesirably thick behind the blade. This may also deteriorate the coating surface quality (after high speed coating), resulting in streaking and surface defects from the agglomerated particles.

It is further believed that precipitated calcium carbonate (in a coating composition fluid having a desired solids content, e.g., 54% or higher, and in combination with the ink-fixing agent) would cause the viscosity of an ink-receiving layer fluid to be too high, such that first/second ink-receiving layers would not be able to be satisfactorily coated/formed at high speeds from the fluids. If the solids content was dropped in order to lower the viscosity, it is believed that the maximum coat weight of the respective first/second ink-receiving layers would be deleteriously affected.

Still further, when precipitated calcium carbonate is included in an ink-receiving layer fluid with an ink-fixing agent, it is believed that the water retention of the ink-receiving layer may be deleteriously affected. Water retention is a measure of the capacity of a composition to keep water in contact with pigment and binder. Precipitated calcium carbonate and the ink-fixing agent may, in combination, reduce the ability of the ink-receiving layer to absorb water and/or the speed at which the ink-receiving layer is able to absorb water. This reduction in water retention may undesirably reduce the minimum blade coating quality/coater runnability of the ink-receiving layer fluid at high speeds.

Examples of the printable recording medium disclosed herein include an ink-fixing agent in at least one of the first ink-receiving layer or the second ink-receiving layer, and exclude precipitated calcium carbonate from each of the first ink-receiving layer and from the second ink-receiving layer. Excluding precipitated calcium carbonate from examples of each of the ink-receiving layers generally avoids the problems mentioned above with regard to coater runnability and coating surface quality.

Image quality performance may be measured in terms of the gamut, black optical density (KOD), gloss, and bleed or coalescence of a printed image. The term "gamut," as referred to herein, means the amount of color space covered by an ink on a medium. Gamut volume may be calculated using L*a*b* values of 8 colors (cyan, magenta, yellow, black, red, green, blue, white). The term "black optical density," as referred to herein, means the ability of a printed image to retard light rays. A higher black optical density equates to a darker colored image and thus, to better image quality performance. The term "gloss," as referred to herein, means the shine or luster of a printed image. A higher gloss is indicative of good image quality performance. The term "bleed," as used herein, refers to the phenomenon of deposited drops of ink bleeding or spreading on a medium. The term "coalescence," as used herein, refers to the phenomenon of separately deposited drops of ink combining together. Bleed or coalescence can lead to blurring of the printed image and therefore, to poor image quality performance.

Durability performance may be measured in terms of the mechability and abrasion resistance of a printed image. The term "mechability," as referred to herein, is a form of durability, and means the ability of a printed image to remain undamaged when rubbed immediately after printing. Printers may contain media rollers, which may pass over images shortly after they are printed (e.g., within a few seconds). The stress applied to the printed image by the media rollers, which may be at elevated temperatures, may damage the image by changing its gloss, optical density, or film uniformity. The media rollers may also damage the printed image by removing pieces of the ink film and/or exposing bare media. A mechability test may simulate these post-printing conditions and determine if the printed image is durable enough to withstand the stress that may be applied by the media rollers. The term "hot coefficient of friction (COF)," as referred to herein, is a form of durability, and means the ability of a printed image to remain undamaged during a corrugation process. A hot COF tool may be used to simulate the hot corrugation process and determine if the printed image is durable enough to withstand the corrugation process. The term "abrasion resistance," as referred to herein means the ability of a printed image to remain undamaged when rubbed. High abrasion resistance can lead to good durability performance.

As used herein, the term "particle size", refers to the diameter of a substantially spherical particle (i.e., a spherical or near-spherical particle having a sphericity of >0.84), or the average diameter of a non-spherical particle (i.e., the average of multiple diameters across the particle). As used herein, the term "median particle size", refers to the D50 or the median diameter of the particle size distribution, where 50% of the population is above the D50 value and 50% is below the D50 value.

Referring now to the figures, one example of the printable recording medium 10 is shown in FIG. 1. The printable recording medium 10 includes a base substrate 12, a first ink-receiving layer 14, and a second ink-receiving layer 16. In some examples, the printable recording medium 10 consists of these components, with no other components. In other examples, the printable recording medium 10 may include additional components, such as a curl control layer 18. A printed article 10' includes an ink layer 20 on the printable recording medium 10. An over-print varnish layer 22 may also be included (if desired) on the ink layer 20 on the printed article 10'.

As mentioned above, the first ink-receiving layer 14 and the second ink-receiving layer 16 each exclude precipitated calcium carbonate. In some examples, the printable recording medium 10 and each of its layers, i.e., the base substrate 12, the first ink-receiving layer 14, the second ink-receiving layer 16, and the curl control layer 18 (when present), exclude precipitated calcium carbonate.

In some examples, the printable recording medium 10 used herein is a coated glossy medium that can be printed on at speeds needed for commercial and other printers such as, for example, a Hewlett Packard (HP) Inkjet Web Press (Hewlett Packard Inc., Palo Alto, Calif., USA). One example of a web press is the HP PageWide T400S Press. The print/durability properties of examples of the printed article 10' in accordance with the present disclosure are better than or comparable to printed on coated media for offset printing.

In some examples, the printable recording medium 10 has a 75° gloss (sheet gloss) that is greater than 60%; in some other examples, that is greater than 65%; and in some other examples, that is greater than 85%. Such gloss is referred to as "Sheet Gloss" and measures how much light is reflected with a 75 degree (°) geometry on the unprinted recording media. 75° Sheet Gloss testing may be carried out by Gloss measurement of the unprinted area of the sheet with a BYK-Gardner Micro-Gloss® 75° Meter (BYK-Gardner USA, Columbia, Md., USA).

The base substrate 12 of the printable recording medium 10 acts as a bottom substrate layer. The base substrate 12 contains a material that serves as a base upon which the first ink-receiving layer 14 and the second ink-receiving layer 16 are applied. The base substrate 12 provides integrity for the resultant printable recording medium 10. The material of the base substrate 12 should have good affinity and good compatibility for the ink that is to be applied to the printable recording medium 10.

Examples of the base substrate 12 include, but are not limited to, natural cellulosic material, synthetic cellulosic material (such as, for example, cellulose diacetate, cellulose triacetate, cellulose propionate, cellulose butyrate, cellulose acetate butyrate and nitrocellulose), material including one or more polymers such as, for example, polyolefins, polyesters, polyamides, ethylene copolymers, polycarbonates, polyurethanes, polyalkylene oxides, polyester amides, polyethylene terephthalate, polyethylene, polystyrene, polypropylene, polycarbonate, polyvinyl acetal, polyalkyloxazolines, polyphenyl oxazolines, polyethylene-imines, polyvinyl pyrrolidones, and combinations thereof. In some examples, the base substrate 12 is a paper base chosen from, for example, paper, cardboard, paperboard, paper laminated with plastics, and paper coated with resin.

Further examples of the base substrate 12 include bleached liner, Kraft liner, white top liner, testliner, mottle white, and cover paper. The base substrate 12 can be either bleached or non-bleached. In some examples, the base substrate 12 can be two ply sheets where the top ply is made of bleached fiber, and the bottom ply is made of unbleached fiber. In another example, the base substrate 12 is made of one single ply of bleached fiber. Kraft pulp from pines or other conifers are suitable fibers for liner paper. In still another example, recycled fibers are used to make the liner paper which is called Testliner. In yet another example, to improve printability, a minor portion of hardwood fiber may be added to the base substrate 12.

The basis weight of the base substrate 12 may be dependent on the nature of the application of the printable recording medium 10 where lighter weights are employed for magazines and tri-folds, and heavier weights are employed for postcards, for example. In some examples, the base substrate 12 has a basis weight of about 60 grams per square meter ($g/m^2$ or gsm) to about 400 gsm, or about 100 gsm to about 250 gsm.

In an example, the base substrate 12 may have a thickness along substantially the entire length ranging between about 0.025 mm and about 0.5 mm.

The first ink-receiving layer 14 of the printable recording medium 10 is formed on one side of the base substrate 12 as shown in FIG. 1. It is to be understood that, as used herein, the terms "formed on", "disposed on", "deposited on", "established on", and the like are broadly defined to encompass a variety of divergent layering arrangements and assembly techniques. These arrangements and techniques include i) the direct attachment of a layer (e.g., the first ink-receiving layer 14) to another layer (e.g., the base substrate 12) with no intervening layers therebetween and ii) the attachment of a layer (e.g., the first ink-receiving layer 14) to another layer (e.g., base substrate 12) with one or more layers therebetween, provided that the one layer being "formed on", "disposed on", "deposited on", or "established on" the other layer is somehow supported by the other layer (notwithstanding the presence of one or more additional material layers therebetween). Further, the phrases "formed directly on", "disposed directly on", "deposited directly on", "established directly on" and/or the like are broadly defined herein to encompass a situation(s) wherein a given layer (e.g., first ink-receiving layer 14) is secured to another layer (e.g., base substrate 12) without any intervening layers therebetween. Any statement used herein which indicates that one layer is on another layer is to be understood as involving a situation wherein the particular layer that is "on" the other layer in question is the outermost of the two layers relative to incoming ink materials being delivered by the printing system of interest. It is to be understood that the characterizations recited above are to be effective regardless of the orientation of the recording medium materials under consideration.

The first ink-receiving layer 14 may provide a good absorption rate of water, solvent and/or ink vehicle (e.g., a rate fast enough that the ink composition does not have a chance to interact and cause bleed and/or coalescence issues at a printing speed of, for example, 100 feet per minute (fpm)). The first ink-receiving layer 14 may also provide good durability and enhance sheet gloss.

In an example, the first ink-receiving layer 14 includes a first inorganic pigment in an amount equal to or greater than 70 wt % based on a total wt % of the first ink-receiving layer 14 and a first ink-fixing agent in an amount ranging from about 3 wt % to about 10 wt % based on the total wt % of the first ink-receiving layer 14. In some examples, the first ink-receiving layer 14 consists of these components, with no other components. In other examples, the first ink-receiving layer 14 may include additional components, such as a first polymeric binder.

The first inorganic pigment of the first ink-receiving layer 14 may be suitable for adjusting the media penetration for ink ingredients and for adjusting gloss levels of the resulting printed image (printed article 10'). As mentioned above, the first inorganic pigment is present in the first ink-receiving layer 14 in an amount equal to or greater than 70 wt % based on the total wt % of the first ink-receiving layer 14. In some examples, the first inorganic pigment is present in the first ink-receiving layer 14 in an amount equal to or greater than 85 wt % (based on the total wt % of the first ink-receiving layer 14).

Examples of the first inorganic pigment include calcined clay, modified calcium carbonate (MCC), fine and/or ultrafine ground calcium carbonate (GCC), and combinations thereof.

An example of calcined clay is commercially available as KAOCAL® from Thiele Kaolin Company (Sandersville, Ga.) and has a particle size distribution of about 83-92% particles finer than 2 μm. Some examples of ground calcium carbonate include HYDROCARB® 60 (a fine ground calcium carbonate having a solids content of about 74% and a median diameter of about 1.4 microns) and HYDROCARB® 90 (an ultrafine ground calcium carbonate having a solids content of about 76% and a median diameter of about 0.7 microns), both available from Omya North America (Cincinnati, Ohio).

The particle size of the first inorganic pigment may also affect the gloss levels of the resulting printed image (printed article 10'). A smaller particle size of the first inorganic pigment may result in a higher gloss level in the resulting print. In an example, the first inorganic pigment has a median particle size ranging from about 0.5 μm to about 5 μm. In another example, the first inorganic pigment has a median particle size ranging from about 0.5 μm to about 2 μm. In still other examples, the inorganic pigment has a median particle size ranging from about 0.75 μm to about 2 μm, or has a median particle size ranging from about 0.5 μm to about 1 μm.

In some examples, the first inorganic pigment is calcined clay; or a mixture of calcined clay and fine ground calcium carbonate; or a mixture of calcined clay and ultrafine ground calcium carbonate; or a mixture of calcined clay and fine ground and ultrafine ground calcium carbonate. In an example, the mixture contains, by dry weight, at least about 50% of fine and/or ultrafine ground calcium carbonate.

In some examples, the first inorganic pigment of the first ink-receiving layer 14 is an ultrafine ground calcium carbonate (having a median particle size of about 0.7 μm), calcined clay (having a particle size distribution of about 83-92% particles finer than 2 μm), and/or a combination thereof.

The first ink-receiving layer 14 also includes the first ink-fixing agent. A reaction may take place between the first ink-fixing agent and a pigment in the ink to fix the pigment. The first ink-fixing agent fixes a printed image at or near the first ink-receiving layer 14. As such, image quality (e.g., bleed, coalescence, text quality, etc.) is controlled. As mentioned above, the first ink-fixing agent is present in the first ink-receiving layer 14 in an amount ranging from about 3 wt % to about 10 wt % based on the total wt % of the first ink-receiving layer 14.

Examples of the first ink-fixing agent include water-soluble mono-valent or multi-valent metallic salts. The metallic salt may include a cation of a metal, such as Group I metals, Group II metals, Group III metals, or transition metals, such as sodium, calcium, copper, nickel, magnesium, zinc, barium, iron, aluminum, and chromium, and combinations thereof. The metallic salt may also include anions, such as chloride, iodide, bromide, nitrate, sulfate, sulfite, phosphate, chlorate, and acetate ions, and various combinations thereof.

Examples of the first ink-fixing agent include calcium chloride, magnesium chloride, calcium bromide, magnesium bromide, calcium nitrate, magnesium nitrate, aluminum chlorohydrate, and combinations thereof. In an example, the ink-fixing agent is calcium chloride ($CaCl_2$).

As mentioned above, the first ink-receiving layer 14 excludes precipitated calcium carbonate.

In some examples, the first ink-receiving layer 14 further includes a first polymeric binder. In an example, the first polymeric binder is present in the first ink-receiving layer 14 in an amount ranging from about 5 wt % to about 20 wt % based on the total wt % of the first ink-receiving layer 14. In another example, the first polymeric binder is present in the first ink-receiving layer 14 in an amount ranging from about 5 wt % to about 10 wt % (based on the total wt % of the first ink-receiving layer 14).

In an example, the first polymeric binder is compatible with each of the first ink-fixing agent and the second ink-fixing agent (when it is included in the second ink-receiving layer 16). Examples of the first polymeric binder may include latex polymers, polyvinyl alcohols and polyvinyl pyrrolidones. The latex polymer may be derived from a number of monomers such as, by way of example and not limitation, vinyl monomers, allylic monomers, olefins, and unsaturated hydrocarbons, and mixtures thereof. Classes of vinyl monomers include, but are not limited to, vinyl aromatic monomers (e.g., styrene), vinyl aliphatic monomers (e.g., butadiene), vinyl alcohols, vinyl halides, vinyl esters of carboxylic acids (e.g., vinyl acetate), vinyl ethers, (meth) acrylic acid, (meth)acrylates, (meth)acrylamides, (meth) acrylonitriles, and mixtures of two or more of the above, for example. The term "(meth) acrylic latex" includes polymers of acrylic monomers, polymers of methacrylic monomers, and copolymers of the aforementioned monomers with other monomers.

Examples of vinyl aromatic monomers that may form the latex polymeric binder include, but are not limited to, styrene, 3-methylstyrene, 4-methylstyrene, styrene-butadiene, p-chloro-methylstyrene, 2-chlorostyrene, 3-chlorostyrene, 4-chlorostyrene, divinyl benzene, vinyl naphthalene and divinyl naphthalene. Vinyl halides that may be used include, but are not limited to, vinyl chloride and vinylidene fluoride. Vinyl esters of carboxylic acids that may be used include, but are not limited to, vinyl acetate, vinyl butyrate, vinyl methacrylate, vinyl 3,4-dimethoxybenzoate, vinyl malate and vinyl benzoate. Examples of vinyl ethers that may be employed include, but are not limited to, butyl vinyl ether and propyl vinyl ether.

In some examples, the binder may be a styrene/butadiene latex copolymer. In some other examples, the binder may be a styrene/butadiene/acrylonitrile latex copolymer. Some examples of the latex polymer/copolymer include aqueous, anionic carboxylated styrene/butadiene copolymer dispersions commercially available under the tradenames LITEX® PX9710, LITEX® 9720, LITEX® 9730 and LITEX® PX9740, from Synthomer (Essex, UK), styrene/butadiene/acrylonitrile copolymers commercially available under the tradenames GENCRYL® 9525 and GENCRYL® 9750, from RohmNova (Akron, Ohio), a styrene/butadiene copolymer commercially available under the tradename STR 5401, from Dow Chemical Company (Midland, Mich.), poly(vinyl alcohol) commercially available under the tradenames MOWIOL® 4-98 and MOWIOL®6-98, from Kuraray America, Inc. (Houston, Tex.), and/or combination(s) thereof.

In some examples, the first ink-receiving layer 14 may also include an additive. The additive may be a rheology modifier, a surfactant, a dispersant for the inorganic pigments, a crosslinker, or a combination thereof. In an example, the additive is present in the first ink-receiving layer 14 in an amount ranging from about 0.1 wt % to about 2 wt % (based on the total wt % of the first ink-receiving layer 14). In another example, the additive is present in the first ink-receiving layer 14 in an amount ranging from about 0.2 wt % to about 1 wt %.

A rheology modifier may be useful for addressing runnability issues. Some examples of suitable rheology modifiers include polycarboxylate-based compounds, polycarboxylate-based alkaline swellable emulsions, and/or their derivatives. The rheology modifier is helpful for building up the viscosity at a certain pH, either at low shear or under high shear, or both. In certain instances, a rheology modifier is added to maintain a relatively low viscosity under low shear, and to help build up the viscosity under high shear. It is generally desirable to provide a coating formulation that is not so viscous during the mixing, pumping and storage stages, but possesses an appropriate viscosity under high shear. Some examples of rheology modifiers include: CARTACOAT® RM 12, commercially available from Clariant International Ltd. (Muttenz, Switzerland); a hydrophobically modified anionic thickener, commercially available under the tradename Acrysol TT-615 from Dow Chemical Company (Midland, Mich.); and an aqueous, anionic dispersion of an ethyl acrylate-carboxylic acid copolymer that is a synthetic thickener with high water retention, commercially available under the tradename Sterocoll® FS from BASF (Charlotte, N.C.). In an embodiment, the amount of rheology modifier in the coating composition may be in the range of 0.1 to 2 dry parts, and, in another embodiment, in the range of 0.1 to 0.5 dry parts.

In an example, the first ink-receiving layer 14 may have a coating weight ranging from about 5 gsm to about 20 gsm. In another example, the first ink-receiving layer 14 may have a coating weight ranging from about 5 gsm to about 15 gsm.

In an example, the first ink-receiving layer 14 may be formed from a first ink-receiving layer fluid, which may include the first inorganic pigment, the first ink-fixing agent, and water. In an example, the first ink-receiving layer fluid may further include the first polymeric binder. An example of the first ink-receiving layer fluid includes greater than or equal to 70 dry parts of the first inorganic pigment, from about 3 dry parts to about 10 dry parts of the first ink-fixing agent, and from about 5 dry parts to about 20 dry parts of the first polymeric binder. The dry parts of the first ink-receiving layer fluid may be combined with water to form a first ink-receiving layer fluid coating including from about 50% to about 60% dry parts, with the balance being water.

The first ink-receiving layer fluid may be applied/coated on the base substrate 12. Examples of suitable coating techniques include, but are not limited to, slot die coaters, roller coaters, fountain curtain coaters, blade coaters, rod coaters, air knife coaters, gravure applications, and air brush applications.

It is to be understood that when the first ink-receiving layer 14 is formed from the first ink-receiving layer fluid, the water is removed during the formation/drying of the first ink-receiving layer 14. The resulting first ink-receiving layer 14 may include greater than or equal to 70 wt % of the first inorganic pigment, from about 3 wt % to about 10 wt % of the first ink-fixing agent, and from about 5 wt % to about 20 wt % of the first polymeric binder (based on the total wt % of the first ink-receiving layer 14).

The second ink-receiving layer 16 of the printable recording medium 10 is formed on the first ink-receiving layer 14. The second ink-receiving layer 16 may provide good durability by protecting and minimizing damage to the printed image (printed article 10'). The second ink-receiving layer 16 may also provide a high gloss to the printable recording medium 10.

The second ink-receiving layer 16 includes a second inorganic pigment. In some examples, the second ink-receiving layer 16 consists of the second inorganic pigment, with no other components. In other examples, the second ink-receiving layer 16 may include additional components, such as a second polymeric binder, a second ink-fixing agent, a wax, or a plastic pigment.

The second inorganic pigment of the second ink-receiving layer 16 may be suitable for adjusting the media penetration for ink ingredients and for adjusting gloss levels of the resulting printed image (printed article 10'). The second inorganic pigment is present in the second ink-receiving layer 16 in an amount ranging from about 70 wt % to about 90 wt % (based on the total wt % of the second ink-receiving layer 16).

Examples of the second inorganic pigment include clay, calcined clay, ground calcium carbonate, aluminum silicate, magnesium carbonate, talc, and combinations thereof.

In some examples, the second inorganic pigment is calcined clay; or a mixture of calcined clay and fine ground calcium carbonate; or a mixture of calcined clay and ultrafine ground calcium carbonate; or a mixture of calcined clay and fine ground and ultrafine ground calcium carbonate. In an example, the mixture contains, by dry weight, at least about 50% of fine and/or ultrafine ground calcium carbonate.

The particle size of the second inorganic pigment may also affect the gloss levels of the resulting printed image (printed article 10'). A smaller particle size of the second inorganic pigment may result in a higher gloss level in the resulting print. In an example, the second inorganic pigment has a median particle size ranging from about 0.1 μm to about 2 μm. In another example, the second inorganic pigment has a median particle size ranging from about 0.1 μm to about 1 μm. In still another example, the second inorganic pigment has a median particle size ranging from about 0.1 μm to about 2 μm, and 60% of the particles have a particle size less 2 μm.

In some examples, the second inorganic pigment of the second ink-receiving layer 16 is an ultrafine ground calcium carbonate (having a median particle size of about 0.7 μm), calcined clay (having a particle size distribution of about 83-92% particles finer than 2 μm), and/or a combination thereof.

In some examples, the second ink-receiving layer 16 includes a second ink-fixing agent. It is believed that a small amount of the second ink-fixing agent in the second ink-receiving layer 16 may further improve ink bleed performance, but that an excessive amount may have negative impact to print gloss and durability. In an example, the second ink-fixing agent is included in the second ink-receiving layer 16 in an amount less than 2 wt % based on the total wt % of the second ink-receiving layer 16. In another example, the second ink-fixing agent is included in the second ink-receiving layer 16 in an amount ranging from greater than 0 wt % to about 2 wt % (based on the total wt % of the second ink-receiving layer 16). In still another example, the second ink-fixing agent is included in the second ink-receiving layer 16 in an amount less than 1 wt %. In still another example, the second ink-fixing agent is included in the second ink-receiving layer 16 in an amount ranging from greater than 0 wt % to about 1 wt %. In yet another example, the second ink-receiving layer 16 contains no second ink-fixing agent.

Examples of the second ink-fixing agent include water-soluble mono-valent or multi-valent metallic salts. The metallic salt may include a cation of a metal, such as Group I metals, Group II metals, Group III metals, or transition metals, such as sodium, calcium, copper, nickel, magnesium, zinc, barium, iron, aluminum, and chromium, and combinations thereof. The metallic salt may also include anions, such as chloride, iodide, bromide, nitrate, sulfate, sulfite, phosphate, chlorate, and acetate ions, and various combinations thereof.

Examples of the second ink-fixing agent include calcium chloride, magnesium chloride, calcium bromide, magnesium bromide, calcium nitrate, magnesium nitrate, aluminum chlorohydrate, and combinations thereof. In an example, the ink-fixing agent is calcium chloride ($CaCl_2$).

In some examples, the weight ratio of the second ink-fixing agent to the first ink-fixing agent is about 1:5. In some other examples, the weight ratio of the second ink-fixing agent to the first ink-fixing agent is about 1:10.

In some examples, the second ink-receiving layer 16 further includes a second polymeric binder. In an example, the second polymeric binder is present in the second ink-receiving layer 16 in an amount ranging from 5 wt % to about 20 wt % based on the total wt % of the second ink-receiving layer 16. In another example, the second polymeric binder is present in the second ink-receiving layer 16 in an amount ranging from 5 wt % to about 10 wt % (based on the total wt % of the second ink-receiving layer 16). The second polymeric binder may be any one of the first polymeric binders listed above for the first ink-receiving layer 14, or any combination thereof. In an example, the second polymeric binder is compatible with each of the first ink-fixing agent and the second ink-fixing agent (when it is included in the second ink-receiving layer 16).

In an example, the first ink-receiving layer 14 includes the first polymeric binder in an amount ranging from about 5 wt % to about 20 wt % based on the total wt % of the first ink-receiving layer 14, and the second ink-receiving layer 16 includes the second polymeric binder in an amount ranging from about 5 wt % to about 20 wt % based on a total wt % of the second ink-receiving layer 16.

In some examples, the second ink-receiving layer 16 also includes a wax. The wax serves to provide scratch resistance and friction reduction. In other words, the wax improves the scratch/rub resistance of the printable recording medium 10. For example, the wax may provide a print standoff for surface abrasion during shipping and/or normal handling/processing. In an example, the wax may be present in the second ink-receiving layer 16 in an amount ranging from greater than 0 wt % to about 5 wt % (based on the total wt % of the second ink-receiving layer 16). In another example, the wax may be present in the second ink-receiving layer 16 in an amount ranging from about 0.5 wt % to about 3 wt %.

Examples of the wax include polypropylene wax, polyethylene wax (e.g., high density polyethylene (HDPE based wax), polytetrafluoroethylene wax, and the like. The wax that is utilized may depend, in part, upon the temperature of the corrugation process and the melting point of the wax and coating composition/second ink-receiving layer 16. In an example, the average particle size of the wax may be equal to or greater than 5 μm. One example of the wax includes ULTRALUBE® D806 (average particle size of 7 μm from Keim-additec Surface GmbH).

In some examples, the second ink-receiving layer 16 also includes a plastic pigment. The plastic pigment, if included, serves to enhance paper gloss. In an example, the plastic pigment may be present in the second ink-receiving layer 16 in an amount ranging from about 0 wt % to about 10 wt % (based on the total wt % of the second ink-receiving layer 16). In a further example, the plastic pigment may be present in a fluid from which the second ink-receiving layer 16 is formed in an amount ranging from about 0 dry parts to about 10 dry parts; or from about 1 dry part to about 8 dry parts; or from about 3 dry parts to about 6 dry parts.

Examples of the plastic pigment may include styrene based pigments and/or hollow sphere type polystyrene based pigments. In some examples, the plastic pigment has a glass transition temperature ($T_g$) equal to or greater than 85° C. In some other examples, the plastic pigment has a $T_g$ equal to or greater than 100° C. One example of the plastic pigment includes ROPAQUE™ AF1055 from Dow Chemical. ROPAQUE™ AF1055 is a hollow sphere styrene acrylic polymeric pigment with a 1.0 μm particle size and a 55% void volume. Another example of the plastic pigment is LYTRON™ HG80 from Omnova Solutions Inc. LYTRON™ HG80 is hollow sphere pigment with a 1 μm unimodal particle size distribution.

In some examples, the second ink-receiving layer 16 may also include an additive. The additive may be a rheology modifier, a surfactant, a dispersant for the inorganic pigments, a dye, an optical brightening agent, a crosslinker, or combination(s) thereof.

Examples of rheology modifier listed above for the first ink-receiving layer 14 are also suitable for the second ink-receiving layer 16. In an example, a rheology modifier used is commercially available under the tradename Sterocoll® FS from BASF (Charlotte, N.C.).

In an example, the additive is present in the second ink-receiving layer 16 in an amount ranging from about 0.1 wt % to about 2 wt % (based on the total wt % of the second ink-receiving layer 16). In another example, the additive is present in the second ink-receiving layer 16 in an amount ranging from about 0.2 wt % to about 1 wt %.

As mentioned above, the second ink-receiving layer 16 may also include a dye. An example of a suitable dye is a violet dye. The amount of dye is sufficient or effective to enhance the color of the second ink-receiving layer 16. In an example, the amount of the dye that is included in the second ink-receiving layer 16 ranges from about 0.001 wt % to about 0.01 wt % (based on the total wt % of the second ink-receiving layer 16). In another example, the dye may be included in the second ink-receiving layer 16 in an amount ranging from about 0.005 wt % to about 0.01 wt %.

The second ink-receiving layer 16 may also include an optical brightening agent. The amount of the optical brightening agent in the second ink-receiving layer 16 is sufficient or effective to enhance the brightness of the second ink-receiving layer 16. In an example, the amount of the optical brightening agent that is included in the second ink-receiving layer 16 ranges from about 0.01 wt % to about 0.5 wt % (based on the total wt % of the second ink-receiving layer 16). In another example, the optical brightening agent may be included in the second ink-receiving layer 16 in an amount ranging from about 0.1 wt % to about 0.5 wt %.

In an example, the second ink-receiving layer 16 may have a coating weight ranging from about 5 gsm to about 15 gsm. In another example, the second ink-receiving layer 16 may have a coating weight that is no more than about 50% of the coating weight of the first ink-receiving layer 14.

In an example, the second ink-receiving layer 16 may be formed from a second ink-receiving layer fluid, which may include the second inorganic pigment and water. In an example, the second ink-receiving layer fluid may further include the second ink-fixing agent, the second polymeric binder, the wax, and/or the plastic pigment. An example of the second ink-receiving layer fluid includes greater than or equal to 70 dry parts of the second inorganic pigment, from greater than 0 dry parts to about 2 dry parts of the second ink-fixing agent, from about 5 dry parts to about 20 dry parts of the second polymeric binder, from greater than 0 dry parts to about 5 dry parts of the wax, and from about 1 dry part to about 6 dry parts of the plastic pigment. The dry parts of the second ink-receiving layer fluid may be combined with water to form a first ink-receiving layer fluid coating including from about 50% to about 60% dry parts, with the balance being water.

The second ink-receiving layer fluid may be applied/coated on the first ink-receiving layer 14. Examples of suitable coating techniques include, but are not limited to, slot die coaters, roller coaters, fountain curtain coaters, blade coaters, rod coaters, air knife coaters, gravure applications, and air brush applications.

It is to be understood that when the second ink-receiving layer 16 is formed from the second ink-receiving layer fluid, the water is removed during the formation/drying of the second ink-receiving layer 16. The resulting second ink-receiving layer 16 may include from about 70 wt % to about 90 wt % of the second inorganic pigment, from 0 wt % to about 2 wt % of the second ink-fixing agent, from about 5 wt % to about 20 wt % of the second polymeric binder, from greater than 0 wt % to about 5 wt % of the wax, and from about 1 wt % to about 6 wt % of the plastic pigment (based on the total wt % of the second ink-receiving layer 16).

In an example of the printable recording medium 10, the first ink-receiving layer 14 is disposed on top of the base substrate 12, and the second ink-receiving layer 16 is disposed on top of the first ink-receiving layer 14. In another example of the printable recording medium 10, the first ink-receiving layer 14 is disposed directly on top of the base substrate 12, and the second ink-receiving layer 16 is disposed directly on top of the first ink-receiving layer 14.

In some examples, the printable recording medium 10 may be a printable package liner. In these examples, the base substrate 12 may be corrugated liner paper and/or paperboard. The first ink-receiving layer 14, the second ink-receiving layer 16 and the curl control layer 18 (when present) may be applied to the base substrate 12 as described above. The ink layer 20 and the over-print varnish layer 22 (when present) may be disposed on the printable recording medium 10 to form the printed article 10'.

Corrugated paper board is a material that includes a fluted corrugated sheet and one or two flat linerboards. It is made on flute lamination machines or corrugators and is used in the manufacture of shipping containers and corrugated boxes. The corrugated medium and linerboard board both are made of kraft containerboard, a paper board material that is usually over 0.01 inches (0.25 mm) thick.

Commonly, the exposed surface(s) of the outer liner(s) is/are printed (i.e., has an image, text, or the like printed thereon). Corrugated boxes, which typically include the corrugated media adhered between two liner sheets are often used as shipping containers and may require printing and labels to identify the contents, to provide legal and regulatory information, and to provide bar codes for routing. Boxes that are used for marketing, merchandising, and point-of-sale often have high graphics to help communicate the contents. Corrugated boxes are used for the shipping of a variety of items due to their strength, durability, lightness, recyclability, and cost-effectiveness.

In some other examples, the first and second ink-receiving layers 14, 16 are applied to one side of the base substrate 12, and the curl control layer 18 is applied to a side of the base substrate 12 opposed to the one side. The curl control layer 18 is to balance the curl of the final product or to improve sheet feeding through printing, overcoat and hot corrugation processes. In an example, the curl control layer 18 includes starch.

In another example (not shown), the first and second ink-receiving layers 14, 16 are applied to both sides of the base substrate 12, with no curl control layer 18.

In some examples, the printable recording medium 10 may further be calendered (either in-line calendered (hard or soft nip), or offline supercalendered) at a suitable speed, temperature, pressure and number of nips to reach a desired smoothness and gloss level.

As shown in FIG. 1, the printable recording medium 10 may have an ink layer 20 disposed on the second ink-receiving layer 16. The ink layer 20 may be formed by printing a liquid ink on the second ink-receiving layer 16. While FIG. 1 shows the ink layer 20 on the second ink-receiving layer 16, the liquid ink 20 may be absorbed by second ink-receiving layer 16 and/or the first ink-receiving layer 14. Thus, the ink layer 20 may be within the second ink-receiving layer 16 and/or the first ink-receiving layer 14. Further, while the ink layer 20 is shown as covering all of the second ink-receiving layer 16, the liquid ink may be printed on less than all of the second ink-receiving layer 16, and thus, the ink layer 20 may cover less than all of the second ink-receiving layer 16.

The liquid ink may include a liquid vehicle and a colorant. The ink may be any color, such as black, cyan, magenta, yellow, etc. In some examples, the ink compositions are inkjet compositions, and as such the ink compositions are well adapted to be used in an inkjet device and/or in an inkjet printing process. The liquid ink may be printed on the printable recording medium 10 by any suitable inkjet printing technique, such as thermal, acoustic, continuous or piezoelectric inkjet printing.

In some examples, the liquid ink is an aqueous inkjet ink composition, and as such the ink composition includes an aqueous liquid vehicle and a colorant. In some examples, the colorant is selected from a black colorant, a cyan colorant, a magenta colorant, and a yellow colorant. The colorant in the liquid ink may be an anionically dispersed colorant that can react with the first and/or second ink-fixing agent in the first ink-receiving layer 14 and/or the second ink-receiving layer 16 (respectively). The ink vehicle may include water and at least one co-solvent present in an amount ranging from about 1 to about 25 wt % (base on the total wt % of the liquid ink). The liquid ink may also contain at least one surfactant present in an amount ranging from about 0.1 to about 8 wt %; at least one polymer present in an amount ranging from about 0 to about 6 wt % by total weight of the ink composition. The liquid ink may further include other components common to inkjet inks, such as antimicrobial agents (e.g., biocides and fungicides), anti-kogation agents (for thermal inkjet printing), etc.

In some other examples, the liquid ink may be chosen from a pigment-based inkjet ink, a pigmented latex-based inkjet ink, a UV curable inkjet ink, a dye-based inkjet ink, or a toner.

As shown in FIG. 1, the printable recording medium 10 may have an over-print varnish layer 22 disposed on the ink layer 20. The over-print varnish layer 22 may protect the ink layer 20, and thus, improve the durability of the printed image (printed article 10'). The over-print varnish layer 22 may also improve the gloss of the printed article 10'.

The over-print varnish layer 22 may be formed on the ink layer 20 by applying an over-print varnish. Examples of the over-print varnish include INXKOTE® AC911 and INXKOTE® AC9116 from INX International, AQUAFLEX® H.R. from Flint Group, and THERMAGLOSS® 1394E, THERMAGLOSS® 426, THERMAGLOSS® 425, THERMAGLOSS® 475, THERMAGLOSS® 460, and DIGIGUARD® gloss 100 from Michelman.

Figure 2:
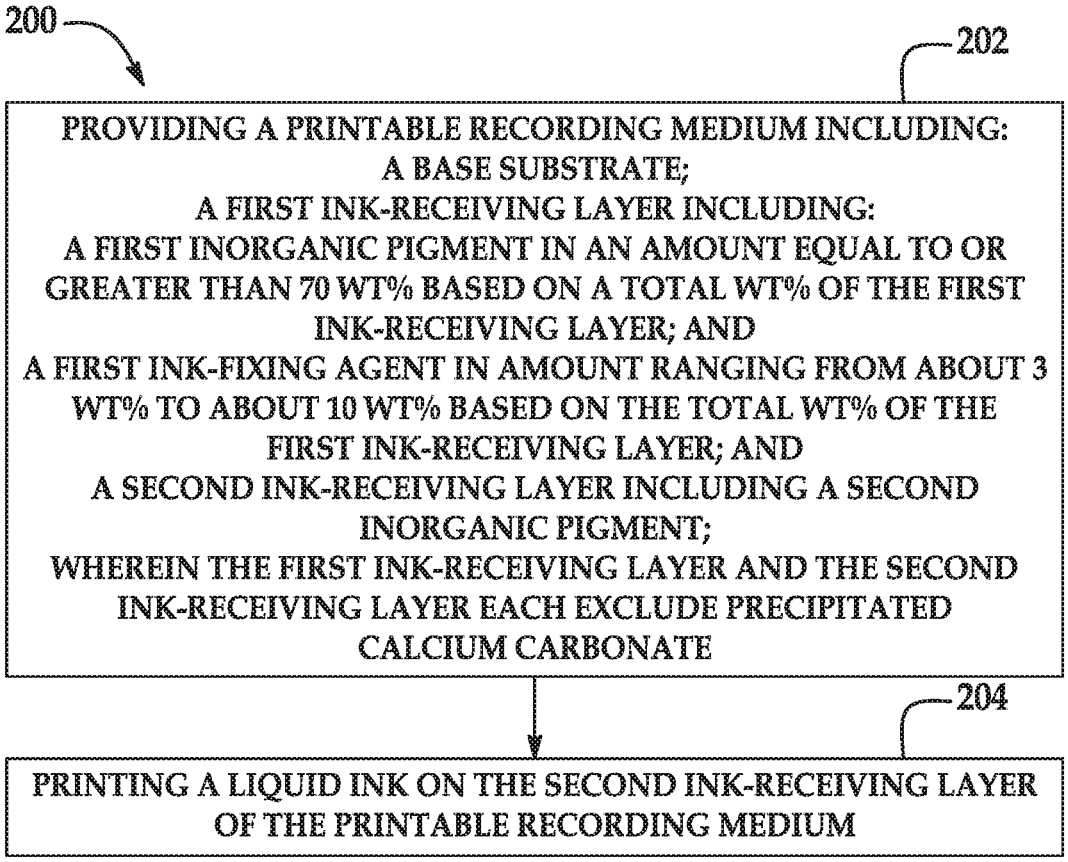
FIG. 2 is a flowchart illustrating an example of a method for producing durable images disclosed herein.

Turning now to FIG. 2, a printing method 200 for producing a durable image is depicted. As shown at reference numeral 202, the printing method 200 includes providing a printable recording medium. The printable recording medium provided may be the printable recording medium 10. In an example, printable recording medium 10 provided in the printing method 200 includes the base substrate 12, the first ink-receiving layer 14, and the second ink-receiving layer 16. The first ink-receiving layer 14 includes the first inorganic pigment in an amount equal to or greater than 70 wt % and the first ink-fixing agent in an amount ranging from about 3 wt % to about 10 wt % based on the total wt % of the first ink-receiving layer 14. The second ink-receiving layer 16 includes the second inorganic pigment. Both the first ink-receiving layer 14 and the second ink-receiving layer 16 exclude precipitated calcium carbonate.

As shown at reference numeral 204, the printing method 200 also includes printing an ink on the second ink-receiving layer 16 of the printable recording medium 10. The liquid ink may be the liquid ink described above in reference to the ink layer 20 (see FIG. 1).

The printing of the liquid ink may be accomplished at high print speeds. In an example, the printing of the liquid ink is accomplished at a print speed of at least 100 feet per minute (fpm). In another example, the liquid ink is printed on the second ink-receiving layer 16 at a print speed ranging from 100 fpm to 1000 fpm. In still another example, the liquid ink is printed on the second ink-receiving layer 16 at a print speed ranging from 400 fpm to 600 fpm.

In an example, the liquid ink may be printed on the second ink-receiving layer 16 of the printable recording medium 10 by an inkjet printing process, such as thermal, acoustic, continuous or piezoelectric inkjet printing.

In some examples, after printing the liquid ink on the second ink-receiving layer 16, the printing method 200 may further comprise applying an over-print varnish onto the printed ink. The over-print varnish may be the over-print varnish described above in reference to the over-print varnish layer 22 (see FIG. 1).

In some examples, the ink is printed in-line, then dried in-line prior to the in-line application of the over-print varnish. The drying of the over-print varnish may be accomplished by in-line drying the printed article 10'. The amount of time which the printed ink is dried may depend on the print speed, the color density, color profile, and the base substrate 12 used. In an example, the moisture content of the printed article 10' after drying ranges from about 1 wt % to about 10 wt % (based on the total wt % of the printed article 10'). In another example, the moisture content of the printed article 10' after drying ranges from about 2 wt % to about 5 wt %.

The printing method 200 may produce images that are durable and/or have high image quality. In an example, the images produced by the printing method 200 are robust to dry rubbing, wet rubbing and hot corrugation processes. In another example, the images produced by the printing method 200 have high gloss and good bleed and coalescence performance.

To further illustrate the present disclosure, an example is given herein. It is to be understood that this example is provided for illustrative purposes and is not to be construed as limiting the scope of the present disclosure.

EXAMPLE

A series of coating compositions was prepared, wherein the first ink-receiving layer/pre-coat layer is designated P, and the second ink-receiving layer/topcoat layer is designated T. In P1, P2 and P3, no precipitated calcium carbonate (PCC) is included, and the ink-fixing agent used is calcium chloride ($CaCl_2$). T1 is a comparative second ink-receiving/topcoat layer and includes PCC. T2 is an example second ink-receiving layer and includes no PCC.

The Control was a commercially available Offset paper with primer applied to enable inkjet printing (38 lb/1000 $ft^2$ Kemiart Graph+ (a double coated (2 layer) white-top kraftliner), commercially available from Metsä Board Americas Corporation, Norwalk, Conn.).

The formulations of the first (P) and second (T) ink-receiving layers, P1, P2, P3, and T1 and T2, respectively, are shown in Tables 1 and 2. Each number represents the dry parts of each component present in a respective layer.

TABLE 1

| Ingredient | P1 (Dry parts) | P2 (Dry parts) | P3 (Dry parts) |
|---|---|---|---|
| KAOCAL ® (Calcined Clay) | 20.0 | 30.0 | 20.0 |
| HYDROCARB ® (fine and/or ultrafine ground $CaCO^3$) | 80.0 | 70.0 | 80.0 |
| MOWIOL ® 4-98 (PVOH Binder) | 5.0 | 5.0 | 5.0 |
| LITEX ® PX 9740 (styrene/butadiene binder) | 8.0 | 8.0 | 8.0 |
| DISPEX ® N40 V (Dispersant) | 0.29 | 0.29 | 0.29 |
| $CaCl_2$ (ink-fixing agent) | 5.0 | 5.0 | 3.5 |

TABLE 2

| Ingredient | T1 (comparative) (Dry parts) | T2 (Dry parts) |
|---|---|---|
| KAOCAL ® (Calcined Clay) | 0 | 20.0 |
| HYDROCARB ® (fine and/or ultrafine ground $CaCO^3$) | 0 | 80.0 |
| OPACARB ® A-40 (PCC) | 100.0 | 0 |
| MOWIOL ® 4-98 (PVOH Binder) | 2.5 | 2.5 |
| LITEX ® PX 9740 (styrene/butadiene binder) | 7.5 | 7.5 |
| ULTRALUBE ® D806 (Wax) | 5.0 | 2.0 |
| ROPAQUE ® AF-1055 (Plastic pigment) | 6.0 | 3.0 |
| DISPEX ® N40 V (Dispersant) | 0.29 | 0.29 |
| $CaCl_2$ (ink-fixing agent) | 0 | 0 |
| STEROCOLL ® FS (Thickener) | 0.5 | 0.5 |

The coating fluids for P1, P2, P3, T1 and T2 were prepared in a mixer. The dry parts were mixed with an amount of water sufficient to prepare the coating fluids, such that each fluid had a solids content at or above 54%. The raw base paper sheets (30 lb/1000 $ft^2$ (146 gsm) bleached liner paper from Georgia-Pacific Paper Company) were coated using a pilot blade coater with a roll applicator at 600 meters per minute (mpm)/about 1970 feet per minute (fpm). The base paper was in-line coated first with the respective first ink-receiving layer fluid/pre-coat fluid (P1, P2 and P3) at a coat-weight of about 12 gsm, and then dried in-line. The respective second ink-receiving layer fluid/topcoat fluid (T1, T2) was then applied in-line at a coat-weight of about 6 gsm on top of the dried respective pre-coat layer and dried in-line. The final coated package liner paper was then calendered on a pilot super-calender (at Centre International de Couchage C.I.C. Inc.) at 200 pounds per square inch (psi), and 90° C. with 11 nips.

The coating performance is shown below in Table 3.

The coated package liner papers were printed using a testbed and HP Edgeline printer which has the same ink as an HP PageWide T400S Press. The speed that was used on the test bed may be correlated to the web press packaging machine at different conditions from about 400 fpm to about 1000 fpm. Some of the factors taken into consideration when correlating the speed of the testbed print to the web press include pen to pen spacing, paper to pen spacing, etc. All trial media were tested on the packaging web press, HP PageWide T400S Press (a high-speed, simplex color inkjet web press for corrugated packaging, from HP Inc., Palo Alto, Calif.) and were checked against the testbed print performance.

Several tests and measurements were made on the resulting printed article (e.g., gamut, black optical density (KOD), bleed, and 75° gloss). Comparative tests were performed using a comparative medium, i.e., the commercially available Offset paper with primer mentioned above. The test results are also illustrated in Table 3. A property that may approximate the conditions experienced in the corrugator is the hot coefficient of friction (Hot COF). This value can be used to ascertain whether a particular print set (ink plus fixer(s)) is likely to survive the corrugation process. To simulate the hot corrugation process, a hot COF tool was used.

Gamut measurement represents the amount of color space covered by the ink on the media. Gamut volume is calculated using L*a*b* values of 8 colors (cyan, magenta, yellow, black, red, green, blue, white) measured with an X-RITE 939 Spectro-densitometer (X-Rite Corporation), using a D65 illuminant and a 2 degree observer angle.

The black optical density (KOD) measures the reflectance of the area filled using an X-RITE 939 Spectro-densitometer. The higher the KOD value is, the darker the black colored image obtained.

The "Sheet Gloss" measures how much light is reflected with 75° geometry on an unprinted media. 75° Sheet Gloss testing was carried out by Gloss measurement of the unprinted area of the sheet with a BYK-Gardner MICRO-GLOSS® 75° Meter (BYK-Gardner USA). The "Image Gloss" measures the gloss of each color. 75° Image Gloss testing was carried out by Average 75° gloss measurement of 8 colors (cyan, magenta, yellow, black, red, green, blue, and white) measured with the BYK-Gardner MICRO-GLOSS® 75° Meter.

Bleed testing was carried out with a bleed stinger pattern. 1016 micron lines (or 40 mil, where 1 mil=$1/1000^{th}$ of an inch) of cyan, magenta, yellow, black, red, green, blue inks, passing through solid area fills of each color, are printed and scanned. The distance in μm is measured for how far each colored line bleeds or infiltrates into the area fill or vice versa. The maximum bleed of any color combination is reported.

The sheet gloss, image gloss, KOD and gamut results in Table 3 below were taken from test media printed on an HP Test Bed. The test media were also printed on an HP PageWide T400S Press, and those results correlate with the results from the Test Bed.

TABLE 3

| Property | P1 (12 gsm) + T2 (6 gsm) | P1 (12 gsm) + T1 (6 gsm) | Control (offset with primer) - 2 layer |
|---|---|---|---|
| Coater Runnability | 4 | 1 (dry coating buildup at blade, and coating gets very thick behind blade) | N/A |
| Coating surface quality | 5 | 2 (very streaky) | N/A |
| Sutherland dry rub with | 5 | N/A | 5 |

TABLE 3-continued

| Property | P1 (12 gsm) + T2 (6 gsm) | P1 (12 gsm) + T1 (6 gsm) | Control (offset with primer) - 2 layer |
|---|---|---|---|
| OPV* | | | |
| Hot COF with OPV | 5 | N/A | 1** |
| Bleed with OPV | 4.4 mil | N/A | 20 mil |
| 75° Sheet Gloss with OPV | 88% | N/A | 92% |
| 75° Image Gloss (full color) with OPV | 88% | N/A | 92% |
| KOD with OPV | 2.1 | N/A | 2.2 |
| Gamut (8 point) with OPV | 33500 | N/A | 33400 |

*The overprint varnish (OPV) used was INXKOTE AC911 from INX International Ink Co., Schaumburg, Illinois
**The 1-5 numbers in the top half of the table are qualitative representations, with 1 representing the worst and 5 representing the best.

Figure 3A:
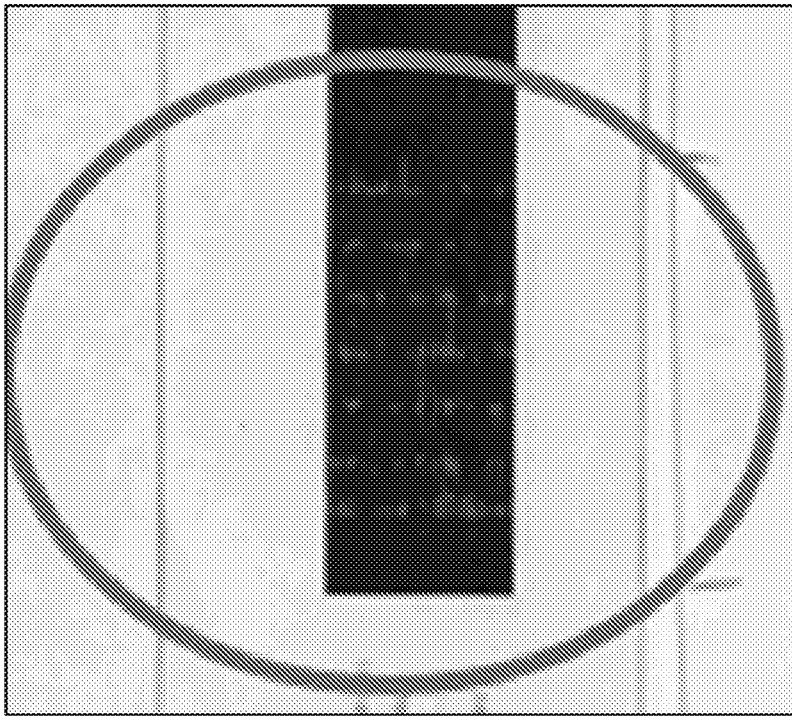
FIG. 3A is a black and white image illustrating the result of a hot coefficient of friction test at 350° F. for ink printed on a comparative offset paper with primer.
Figure 3B:
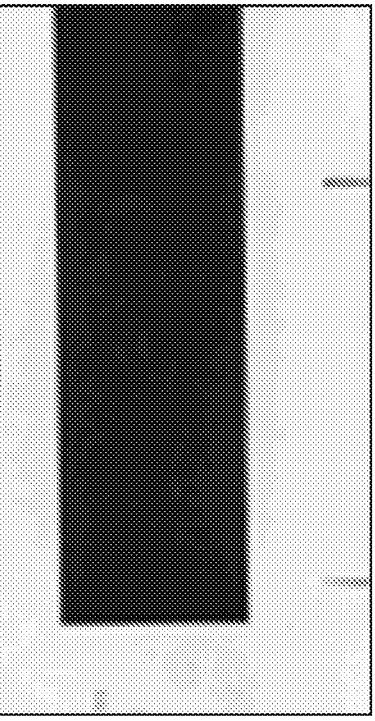
FIG. 3B is a black and white image illustrating the result of a hot coefficient of friction test at 350° F. for ink printed on an example multilayered coating composition.

The hot COF test resembled the corrugating facility, where the print and the corrugated back is dragged on a hot metal surface at a temperature ranging from about 330° F. to about 360° F. The hot COF tool test heats up a thin metal piece to 350° F. The dense printed media was placed on the hot metal with a corrugated piece in the back along with a 2 kg weight, and then was dragged at a constant speed for about 1 inch. FIG. 3A is a black and white image illustrating the result of the hot COF for ink printed on the comparative offset paper with primer, showing ink undesirably removed, streaking and white areas—this is ranked a "1" on the 1-5 scale. FIG. 3B is a black and white image illustrating the result of the hot COF test for ink printed on an example (P1+T2) multilayered coating composition, showing ink black and uniform—this is ranked a "5" on the 1-5 scale.

Figure 4A:
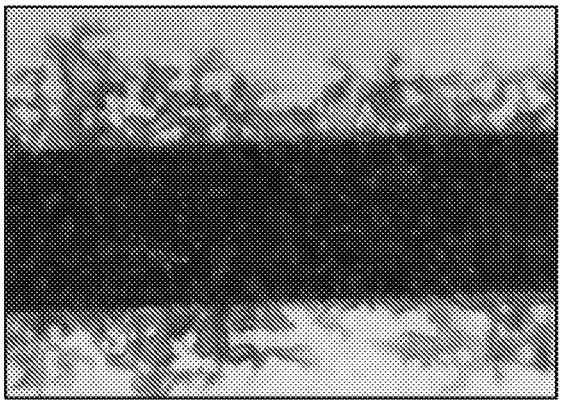
FIG. 4A is a black and white image illustrating poor bleed control for a printed ink.
Figure 4B:
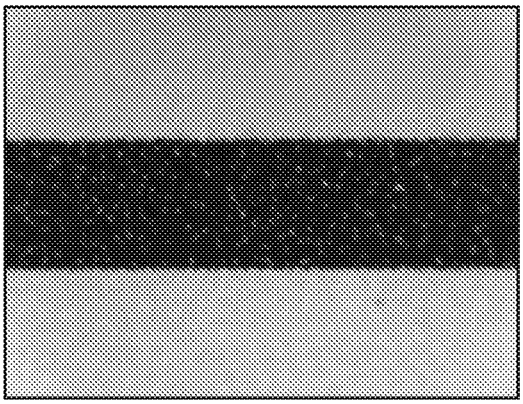
FIG. 4B is a black and white image illustrating bleed control for ink printed on an example multilayered coating composition.

FIG. 4A is a black and white image illustrating poor/unacceptable bleed control for a printed ink. FIG. 4B is a black and white image illustrating good bleed control for ink printed on an example (P1+T2) multilayered coating composition.

The results shown in Table 3 reveal that the inclusion of precipitated calcium carbonate in the second ink-receiving layer/topcoat T1 caused difficulties with coater runnability and coating surface quality to the extent that the paper could not be successfully coated with the ink-receiving layers. A printed article having ink on a printable medium including the combination of P1 and T2 (with ink-fixing agent ($CaCl_2$) in P1 and no PCC in either of P1 or T2) provides comparable black optical density, sheet gloss, image gloss and gamut as the Control, but significantly better hot COF results than the Control.

The combinations of P2 and T2, and P3 and T2 both provided excellent results (comparable to the combination of P1 and T2) from the hot COF test.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

It is to be understood that the ranges provided herein include the stated range and any value or sub-range within the stated range. For example, a range from about 3 wt % to about 10 wt % should be interpreted to include not only the explicitly recited limits of from about 3 wt % to about 10 wt %, but also to include individual values, such as 3.25 wt %, 5 wt %, 7.5 wt %, etc., and sub-ranges, such as from about 4.25 wt % to about 8 wt %, from about 5.25 wt % to about 7.75 wt % etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described in detail, it is to be understood that the disclosed examples may be modified. Therefore, the foregoing description is to be considered non-limiting.

What is claimed is:

1. A printable recording medium, comprising:
a base substrate;
a first ink-receiving layer disposed on top of the base substrate, the first ink-receiving layer including:
a first inorganic pigment in an amount equal to or greater than 70 wt% based on a total wt% of the first ink-receiving layer; and
a first ink-fixing agent in an amount ranging from about 3 wt% to about 10 wt% based on the total wt% of the first ink-receiving layer; and
a second ink-receiving layer disposed on top of the first ink-receiving layer, the second ink-receiving layer including from about 70 wt% to about 90 wt%, based on a total wt% of the second ink-receiving layer, of a second inorganic pigment selected from the group consisting of clay, calcined clay, ground calcium carbonate, aluminum silicate, magnesium carbonate, talc, and combinations thereof, the second inorganic pigment having a median particle size ranging from about 0.1 μm to about 2 μm;
wherein the first ink-receiving layer and the second ink-receiving layer each exclude precipitated calcium carbonate.

2. The printable recording medium as defined in claim 1 wherein the first inorganic pigment is selected from the group consisting of calcined clay, modified calcium carbonate, ultra-fine ground calcium carbonate, and combinations thereof.

3. The printable recording medium as defined in claim 1 wherein the first ink-fixing agent is selected from the group consisting of calcium chloride, magnesium chloride, calcium bromide, magnesium bromide, calcium nitrate, magnesium nitrate, aluminum chlorohydrate, and combinations thereof.

4. The printable recording medium as defined in claim 1 wherein the first inorganic pigment has a median particle size ranging from about 0.5 μm to about 5 μm.

5. The printable recording medium as defined in claim 1 wherein the second ink-receiving layer includes less than 2 wt% of a second ink-fixing agent based on the total wt% of the second ink-receiving layer.

6. The printable recording medium as defined in claim 5 wherein a weight ratio of the second ink-fixing agent to the first ink-fixing agent is about 1:5.

7. The printable recording medium as defined in claim 1 wherein the printable recording medium is a printable package liner.

8. The printable recording medium as defined in claim 1 wherein the first and second ink-receiving layers are applied to one side of the base substrate, and wherein the printable recording medium further comprises:
a curl control layer applied to a side of the base substrate opposed to the one side.

9. The printable recording medium as defined in claim 1 wherein:

the first ink-receiving layer further includes a first polymeric binder in an amount ranging from about 5 wt% to about 20 wt% based on the total wt% of the first ink-receiving layer; and the second ink-receiving layer further includes a second polymeric binder in an amount ranging from about 5 wt% to about 20 wt% based on the total wt% of the second ink-receiving layer.

10. A printing method for producing a durable image, comprising:

providing a printable recording medium including:

a base substrate;

a first ink-receiving layer disposed on top of the base substrate, the first ink-receiving layer including:

a first inorganic pigment in an amount equal to or greater than 70 wt% based on a total wt% of the first ink-receiving layer; and a first ink-fixing agent in an amount ranging from about 3 wt% to about 10 wt% based on the total wt% of the first ink-receiving layer; and a second ink-receiving layer disposed on top of the first ink-receiving layer, the second ink-receiving layer including from about 70 wt% to about 90 wt%, based on a total wt% of the second ink-receiving layer, of a second inorganic pigment selected from the group consisting of clay, calcined clay, ground calcium carbonate, aluminum silicate, magnesium carbonate, talc, and combinations thereof, the second inorganic pigment having a median particle size ranging from about 0.1 μm to about 2 μm;

wherein the first ink-receiving layer and the second ink-receiving layer each exclude precipitated calcium carbonate; and printing a liquid ink on the second ink-receiving layer of the printable recording medium.

11. The printing method as defined in claim 10 wherein the printing of the liquid ink is accomplished at a print speed of at least 100 feet per minute (fpm).

12. The printing method as defined in claim 10 wherein after printing the liquid ink on the second ink-receiving layer, the method further comprises applying an over-print varnish onto the printed ink.

13. The printable recording medium as defined in claim 1 wherein the second ink-receiving layer further includes a polymeric binder, a wax, a plastic pigment, a dispersant, and a rheology modifier.

14. The printable recording medium as defined in claim 13, wherein the second ink-receiving layer consists of:

the second inorganic pigment;

the polymeric binder present in an amount ranging from about 5 wt% to about 10 wt% based on the total wt% of the second ink-receiving layer;

a wax ranging present in an amount from greater than 0 wt% to about 5 wt% based on the total wt% of the second ink-receiving layer;

a plastic pigment present in an amount from greater than 0 wt% to about 10 wt% based on the total wt% of the second ink-receiving layer;

a dispersant present in an amount from about 0.1 wt% to about 2 wt% based on the total wt% of the second ink-receiving layer; and a rheology modifier in an amount from about 0.1 wt% to about 2 wt% based on the total wt% of the second ink-receiving layer.

* * * * *